US005277233A

United States Patent [19]

Fleming

[11] Patent Number: 5,277,233

[45] Date of Patent: Jan. 11, 1994

[54] OVERFILL SAFETY ADAPTER

[76] Inventor: Larry L. Fleming, 1041 N. 31st St., Camden, N.J. 08105

[21] Appl. No.: 817,162

[22] Filed: Jan. 6, 1992

[51] Int. Cl.[5] ..... B67C 11/00

[52] U.S. Cl. ..... 141/201; 141/DIG. 1; 141/204; 141/96; 73/294; 222/567

[58] Field of Search ..... 141/95, 96, 199, 200, 141/201, 203, 204, 205, DIG. 1; 73/294; 222/567-570

[56] References Cited

U.S. PATENT DOCUMENTS

| | | | |
|---|---|---|---|
| 690,576 | 1/1902 | Hesse | 141/340 |
| 2,715,488 | 8/1955 | Conlon | 141/201 X |
| 3,123,106 | 3/1964 | Parhaniemi | 141/204 |
| 3,176,728 | 4/1965 | Baumann | 141/199 |
| 4,598,743 | 7/1986 | Milling | 141/296 |
| 4,600,125 | 7/1986 | Maynard, Jr. | 222/81 |
| 4,712,595 | 12/1987 | Wilson | 141/201 |
| 4,804,026 | 2/1989 | Bailey | 141/340 |

FOREIGN PATENT DOCUMENTS

| | | | |
|---|---|---|---|
| 348251 | 12/1920 | Fed. Rep. of Germany | 141/201 |
| 18624 | 2/1914 | France | 141/199 |
| 1375560 | 2/1988 | U.S.S.R. | 141/DIG. 1 |
| 16111 | of 1909 | United Kingdom | 141/341 |

*Primary Examiner*—Ernest G. Cusick

*Attorney, Agent, or Firm*—Norman E. Lehrer; Franklyn Schoenberg

[57] ABSTRACT

An overfill safety adapter is provide which is suitable for use on the outlet end of funnel like devices being used to transfer fluid from one container to another to prevent the overfill of the container and spilling of the fluid which includes an elongated frusto conical shaped housing member adapted to be releasably fitted within an opening of a container to be filled having a bore therethrough, the bore of the housing having a conically shaped upper portion adapted to be releasably mounted on an outlet end of a funnel or spout and a substantially cylindrically shaped lower discharge portion which slidably supports a float operably responsive to the level of fluid in a container; and a magnetically operative valve within the bore of the housing which magnetically co-acts with the float to close the flow of fluid through the bore responsive to the level of fluid in a container to be filled.

5 Claims, 3 Drawing Sheets

OVERFILL SAFETY ADAPTER

FIELD OF THE INVENTION

The present invention relates to fluid transfer devices and, more particularly, to an overfill safety device suitable for funnels, fluid transfer spouts and the like used while filling liquid fuel containers and the like in prevention of spillage of the liquid.

BACKGROUND OF THE INVENTION

A common problem when filling a tank or other container with fluid through a small aperture, such as kerosene heaters, gasoline cans, lawn mower fuel tanks and the like, is overflow of the fluid such as fuel when the tank or container is overfilled due to the difficulty in observing the fill level. Overfilling and spilling of the fluid where such fluid is toxic, flammable or expensive presents possible safety hazards or damage that is quite apparent.

Various types of funnels and the like devices have been proposed for transferring fluids such as fuel from one container to another, which are designed to prevent or limit spilling of the fluid including, for example, funnels with fill or float indicators such as disclosed in U.S. Pat. Nos. 4,796,470 and 4,901,776, funnels with float operative sealing valves as disclosed in U.S. Pat. Nos. 2,715,488 and 4,712,595 and funnels with specially configured spouts such as disclosed in U.S. Pat. No. 4,913,201. While such devices have been suggested for solving a long standing problem, none of the proposed devices appear to have received wide commercial acceptance, probably due to high costs, lack of dependability of operation, complicated construction and the like. Moreover, the proposed devices are generally incorporated into or used in conjunction with only one funnel or the like device, further limiting the ready accessibility and use thereof. There is, thus, the continuing need for a simply constructed, generally low-cost and dependably operating funnel or the like device for transferring fluid from one container to another which would serve to prevent overfilling of the container to be filled. Particularly advantageous and desirable would be a device adapted to be used with more than one conventional funnel or the like of different configuration and/or size having means for preventing overfill when transferring fluids from one container to another and which also permits draining excess fluid retained within the filling device without spilling.

SUMMARY OF THE INVENTION

It is accordingly an object of the present invention to provide a dependably operating device adapted for mounting on the outlet end of a funnel, spout or similar device for transferring fluid from one receptacle to another which may be used with receptacles having different sized openings to prevent overfill of the container being filled and spilling of the fluid.

It is another object of the present invention to provide a simply constructed, dependably operating device adapted for being readily releasably mounted on the outlet end of a funnel or spout of different sizes which may be used with containers having different sized openings whereby fluid may be transferred from one container to another without overfilling the container with the fluid being transferred thereto and without spilling any of the fluid.

It is a further object of the present invention to provide a device releasably mountable on the outlet end of a funnel or spout used to transfer fluid from one receptacle to another whereby the fluid feed to the receptacle being filled will be automatically terminated through the funnel or spout in response to fluid level in the filled receptacle.

It is a still further object of the present invention to provide a device adapted for being readily mounted on the outlet end of a funnel or spout having float means that terminates automatically the fluid feed to a receptacle through the funnel or spout responsive to the fluid level in the receiving receptacle without spilling any of the fluid or permitting overfill of fluid in the receptacle.

In accordance with the present invention there is provided an overfill safety adapter suitable for use on the outlet end of funnel like devices being used to transfer fluid from one container to another, said adapter comprising:

an elongated frusto conical shaped housing member with a bore therethrough, said housing member being adapted to be releasably fitted in an opening of a container to be filled, said bore having a conically shaped upper portion adapted to be sealably mounted on an outlet end of a funnel or spout and a substantially cylindrically shaped lower discharge portion; and valve means within the bore of said housing to close the flow of fluid through said bore responsive to the level of fluid in a container to be filled.

In another aspect of the invention there is provided a safety funnel to prevent fluid overfill of a container, said funnel comprising:

a reservoir body;

a depending elongated discharge spout; and an overfill safety adapter releasably mounted about the discharge spout with the bore thereof in communication with said discharge spout, said safety adapter comprising:

a frusto conical shaped housing member with a bore therethrough adapted to be releasably fitted in an opening of a container to be filled;

a float member slidingly supported within the bore of said housing member; and valve means within the bore of said housing member being operable by said float number to close the flow of fluid through said funnel spout responsive to the level of fluid in a container to be filled with fluid through said funnel.

Other objects, features and advantages will be readily apparent from the following detailed description of a preferred embodiment thereof taken in conjunction with the drawings.

BRIEF DESCRIPTION OF THE DRAWINGS

For the purpose of illustrating the invention, there are shown in the accompanying drawings forms which are presently preferred; it being understood that the invention is not intended to be limited to the precise arrangements and instrumentalities shown.

DESCRIPTION OF THE PREFERRED EMBODIMENT

Figure 1:
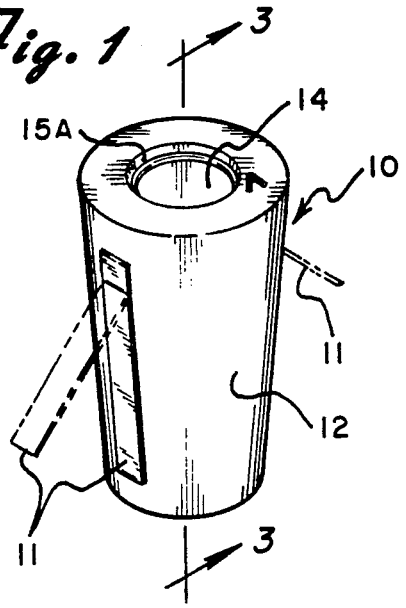
FIG. 1 is a top perspective view, part in phantom, of an overfill safety adapter device embodying the principles of the present invention.
Figure 2:
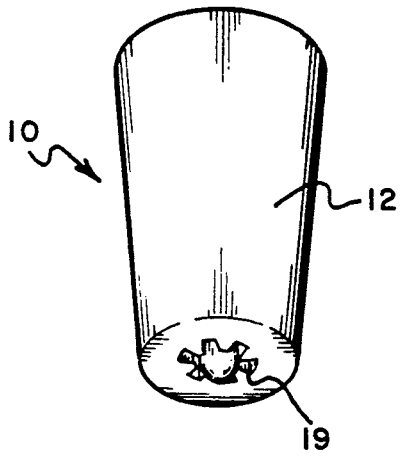
FIG. 2 is a bottom view, in perspective, of the overfill safety adapter device shown in FIG. 1.

Referring now to the drawings wherein like reference numerals identify like parts, there is shown in FIGS. 1 to 7 an overfill safety adapter device of the present invention designated generally as 10, which includes a frusto conical shaped housing member 12 with a bore 14 therethrough having a conically shaped upper bore portion 16 and a cylindrically shaped lower discharge bore portion 17 within which a float member 20 is slidably mounted, and a valve 18 fixed within the bore 14 generally intermediate the upper 16 and lower 17 bore portions.

The housing member 12 is of a frusto conical outer configuration permitting the fitting, and preferably sealing engagement, thereof in containers having different size openings and includes a bore 14 therethrough with an upper orifice 15A to fit about a funnel discharge spout or the like and a lower orifice 15B to provide for the discharge of fluid into a container as well as sliding support for the operation of a float member 20 responsive to the level of fluid in a container being filled. The overfill adapter 10 may include two or more hinged wings 11 mounted about the outer periphery of the adapter 10 which, when expanded, permits the overfill adapter 10 to be fitted or supported in the opening of a fluid tank or receptacle to be filled which is larger than the outer diameter of the adapter 10. In this application, the hinged wings will provide support for the adapter 10 and funnel in the opening of the receiving tank or receptacle during the transfer of a fluid thereto. The housing member 12 may be fabricated by conventional molding techniques from any suitable strong, substantially semirigid plastic, rubber or the like material which is somewhat resilient and substantially resistant to a variety of fluids such as fuel, lubricants and the like whereby the housing may be integrally formed or portions thereof may be fabricated separately from suitable materials and then assembled by conventional techniques.

As indicated, the upper portion 16 of the bore 14 through the housing 12 is conically shaped which permits separable fitting about a funnel discharge spout or the like of different sizes. Sealing embers such as annular "O" rings or the like are spacedly mounted within the upper bore portion 16 about the periphery thereof to serve as seals between a funnel discharge spout and the overfill adapter 10 when such is mounted about a funnel. Also fixed within the bore 14 is a strainer 30 which serves to remove solid contaminants from fluids without restraining passage of the fluid.

The float member 20, a buoyant cylindrical member with a rounded top and bottom ends 21A and 21B, made of lightweight plastic or similar material which is substantially fluid resistant and non-absorbent, is supported and guided for slidable movement within the cylindrically shaped lower discharge portion 17 of the bore 14. The rounded top end 21A is fabricated of a metallic or the like material that is interactive with a magnet. The cylindrically shaped lower bore portion 17 includes a plurality of spaced longitudinal generally parallel grooves 19 about the periphery of the lower bore portion 17 of the housing member 12 which extend between the valve 18 fixed within the bore 14 and the discharge orifice 15B of the adapter 10. A stop flange 19A is located within one of the spaced grooves 19 adjacent an edge thereof, which in cooperation with the projection or prong 31 extending from the side of the float member 20, serves to retain the float member 20 within the cylindrical bore 17. The spaced longitudinal grooves 19 in the cylindrical portion of the bore 17 provide passages through which fluid can pass about the float member 20.

Figure 4:
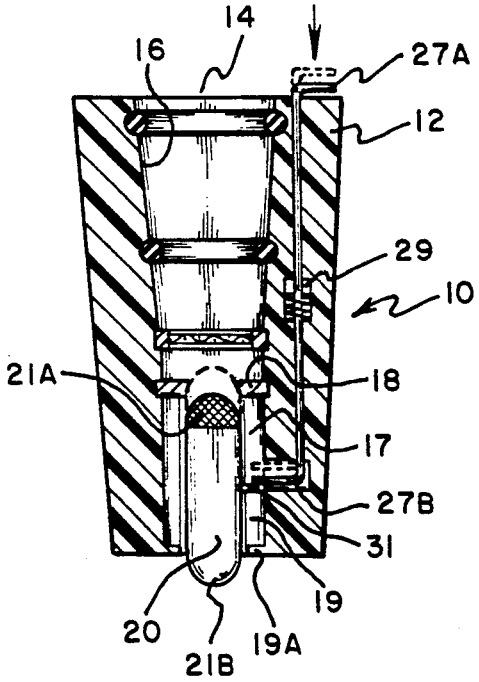
FIG. 4 is a cross-sectional view, part in phantom, taken on line 3—3 of FIG. 1.
Figure 5:
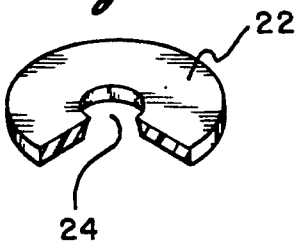
FIG. 5 is an enlarged perspective view, part broken away, of a magnetic sealing member of the overfill safety adapter device shown in FIG. 1.
Figure 6:
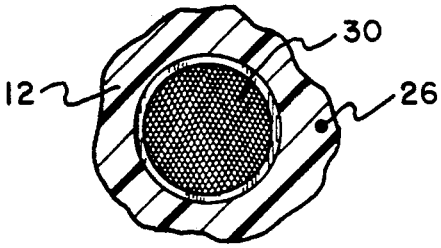
FIG. 6 is a cross-sectional view, part in broken away, taken on line 6—6 of FIG. 3.
Figure 7:
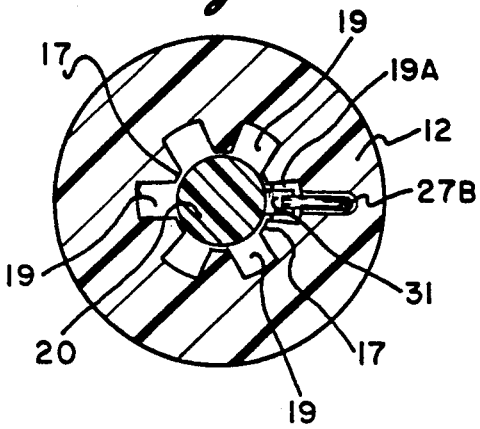
FIG. 7 is a cross-sectional view taken on line 7—7 of FIG. 3.

The valve 18 is comprised of a ring magnet 22 fixed within the bore 14 of the housing 12, generally at the joinder of the conically shaped upper portion 16 and the cylindrically shaped lower portion 17, having a central opening 24 to permit the passage of fluid therethrough while serving to receive the metallic top end 21A of the float 20. The magnet 22 acts as a valve seat against which the metallic member, e.g. the top end 21A of the float member 20, may be moved into and out of seating engagement against the ring magnet 22 valve seat as shown in FIG. 4, when the amount of fluid in the container to be filled is sufficient to cause the float 20 to rise. The metallic member on the top end 21A of the float 20, which will be magnetically attracted by the magnet 22, has an outer diameter greater than the central opening 24 of the magnet 22 to provide a seating relation in the valve closed position which effectively seals the funnel spout to prevent the flow of fluid. As indicated, the float member 20 is of a generally cylindrical shape. The outer diameter of the float member 20 is substantially the same as the internal diameter of the cylindrically shaped portion 17 of the bore 14, the bore 17 thus providing guide support for operation of the float 20. The longitudinal grooves 19 within the cylindrical shaped bore portion 17 provide for passage of fluid about the float 20 when the valve 18 is in the open position. It should be apparent that the positional relationship of the magnet 22 and metallic member 21A may be reversed as desired.

Figure 3:
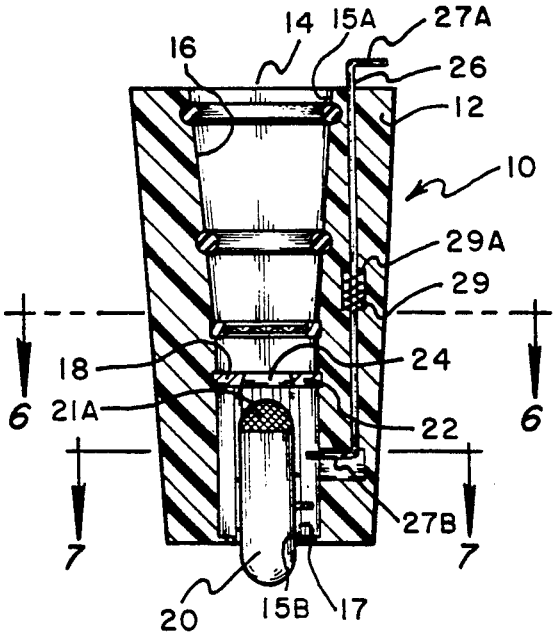
FIG. 3 is a cross-sectional view taken on line 3—3 of FIG. 1.

To serve as a manual operator for opening the valve 18, a vertical guide rod 26 is slidably guided by a bore within the wall of the housing member 12. The top end 27A of the guide rod 26 projects from the top end of the housing member 12 and the lower end 27B, which is right angularly bent, projects into a recess 28 formed in the cylindrical portion 17 of the bore in communication with one of the grooves 19 therein. The passage within the wall of the housing member 12 through which the guide rod 26 slidably operates includes a chamber 29 intermediate the ends of the passage within which a helical spring 29A biases the guide rod 26 into a generally normal uppermost position (FIG. 3). The guide rod, thus, does not interfere with the automatic operation of the float responsive to the level of fluid in a container or closing the valve 18 by the magnetic interaction of the magnet 22 and metallic end 21A of the float. The valve is opened as desired by manually depressing the top portion 27A of the guide rod 26 which acts on the prong 31 projecting from the float 20 to unseat the metallic end 21A away from the magnetic force of the magnet valve seat 22, as shown in FIG. 4.

Figure 8:
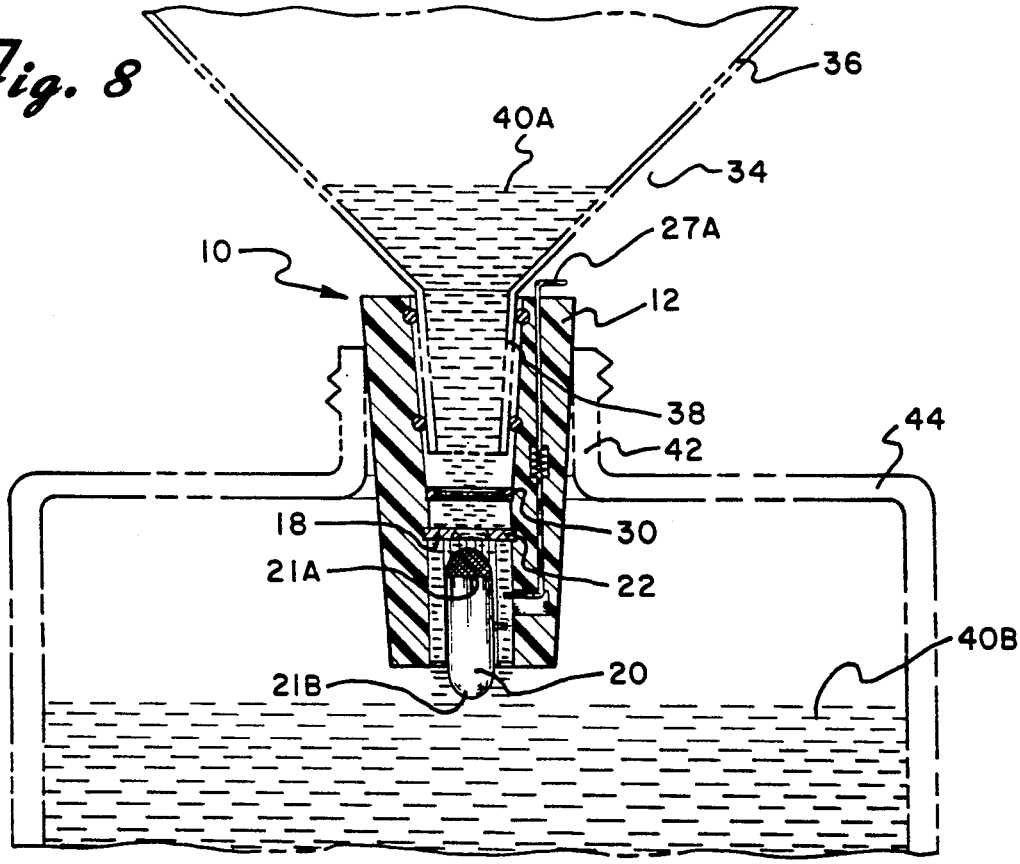
FIG. 8 is a cross-sectional view, part in phantom, of an overfill safety adapter device taken on line 3—3 of FIG. 1 illustrating the adapter device mounted on the outlet end of a funnel disposed within the neck of an opening in a container being filled with a fluid.
Figure 9:
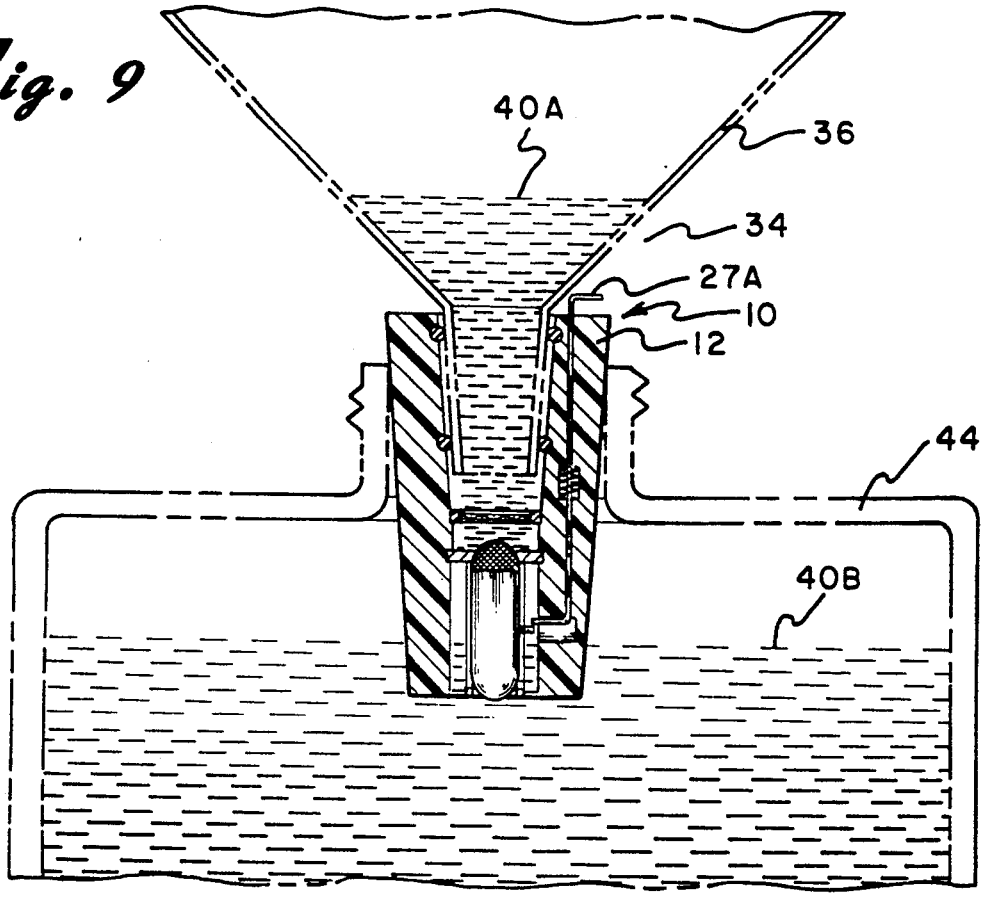
FIG. 9 is a cross-sectional view, part in phantom, of an overfill safety adapter device taken on line 3—3 of FIG. 1 mounted as shown in FIG. 8, illustrating operation of the float sealing mechanism of the overfill safety device responsive to the fluid level in the container to be filled.

Referring now to FIG. 8 and 9, there is illustrated the use of the safety adapter of the present invention in combination with any standard funnel 34. The adapter 10 is mounted about the discharge spout 38 of the funnel 34 and the funnel/adapter combination is fitted in the opening 42 of the container to be filled 44. It should be apparent that the adapter 10 may be first fitted in the opening 42 of the container 44 and the funnel 34 can then be inserted therein as desired.

The valve 18 is opened by manually depressing guide rod 26 to unseat the float 20 away from the magnet valve seat 22, as shown in FIG. 8. Fluid 40A is then poured into the reservoir body 36 of the funnel 34 in the usual manner to fill the container 44. When the fluid level 40B in the container 44 reaches the top portion of the container and contacts the float 20, the buoyancy of the float 20 causes it to rise within the bore 17 of the housing member 12. Engagement of the top metallic portion 21A of the float against the magnet valve seat 22 cause the closing of the valve 18 as shown in FIG. 9. Further flow through the funnel spout 36 is shut off, preventing overfill of the container 44 and spillage. In the valve closing operation, the buoyancy force of the fluid and the magnetic attraction of the valve members provide a combined force to automatically effect a rapid seating force to shut off the flow of the fluids into the container.

With the valve 18 closed, excess fluid in the funnel 34, as shown in FIG. 9, can be readily drained into another container by manually depressing the top end 27A of the guide rod 26 to open the valve 18. However, the valve 18 is maintained in the closed position for movement of the combined funnel 34 and adapter 10 from one container to another by the magnetic attraction between the magnet valve seat 22 and metallic end 21A of the float 20.

Figure 10:
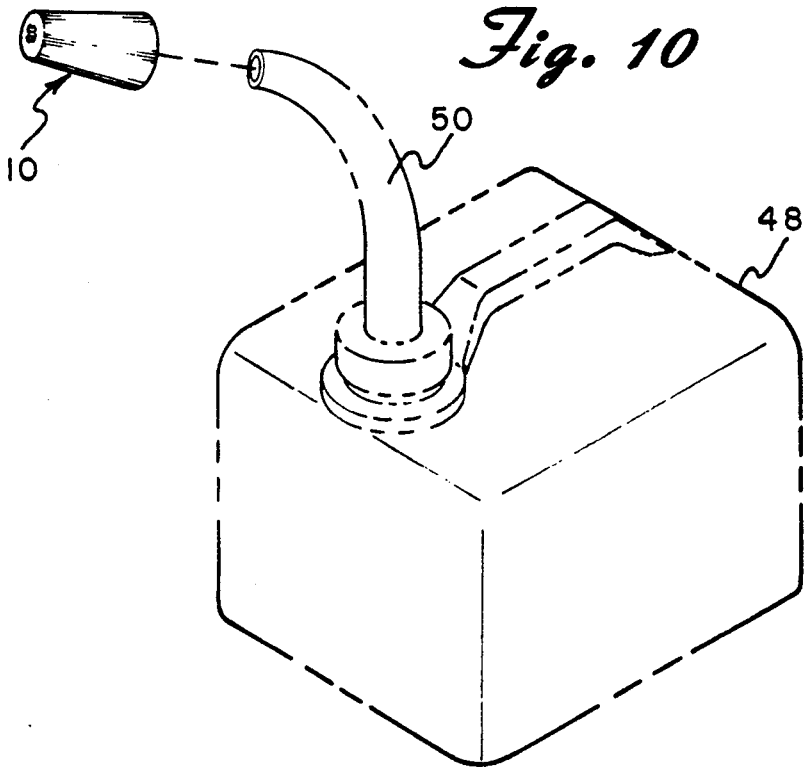
FIG. 10 is a perspective view, in phantom, of a conventional fuel container having a filling spout mounted on the outlet end thereof showing the safety adapter device of FIG. 1 adapted for mounting on the outlet end of the spout in preparation for transferring fluid to another container.

In FIG. 10, there is illustrated the fitting of the overfill adapter 10 on the end of a filler spout attached to a container 48 such as a fuel can, from which fuel is to be transferred to the fuel tank of a lawn mower or similar apparatus. In this application, the adapter 10 would be fitted into the filler opening of the fuel tank with the similar operative effect in preventing overfill and spilling of the fuel.

The present invention may be embodied in other specific forms without departing from the spirit or essential attributes thereof and accordingly reference should be made to the appended claims rather than to the foregoing specification as indicating the scope of the invention.

What is claimed is:

1. An overfill safety adapter suitable for use about the outlet end of funnels or spouts being used to transfer fluid from one container to another, said adapter comprising:

an elongated housing member with at least a portion of its outer surface being of a substantially frusto conical shape adapted to be releasably fittably within an opening of a container to be filled having a bore therethrough, said bore having a conically-shaped upper portion having a substantially universal mounting means for releasably mounting said adapter about an outlet end of a variety of different size funnels or spouts and a substantially cylindrically-shaped lower discharge portion, and valve means including magnet means adopted to serve as a valve seat and valve sealing means operatively disposed within said cylindrically-shaped lower discharge portion of said bore responsive to fluid level in a container to be filled, said valve sealing means including a slidably supported float member within said cylindrically-shaped lower portion having a metallic top end which magnetically co-acts with said magnet means, said float member being adapted to operate responsive to the level of fluid in a container to be filled.

2. An overfill safety adapter suitable for use about the outlet end of funnels or spouts being used to transfer fluid from one container to another, said adapter comprising:

an elongated housing member with at least a portion of its outer surface being of a substantially frusto conical shape adapted to be releasably fittably within an opening of a container to be filled having a bore therethrough, said bore having a conically-shaped upper portion having a substantially universal mounting means for releasably mounting said adapter about an outlet end of a variety of different size funnels or spouts and a substantially cylindrically-shaped lower discharge portion, valve means within the bore of said adapter housing to close the flow of fluid through said bore responsive to the level of fluid in a container to be filled, and said housing member including manually-operated valve opening means attached to and extending from said valve means for opening said valve means as desired.

3. An overfill safety adapter suitable for use about the outlet end of funnels or spouts being used to transfer fluid from one container to another, said adapter comprising:

an elongated housing member with at least a portion of its outer surface being of a substantially frusto conical shape adapted to be releasably fittably within an opening of a container to be filled having a bore therethrough, said bore having a conically shaped upper portion adapted to be releasably mounted about an outlet end of a funnel or a spout and a substantially cylindrically shaped lower discharge portion; and valve means within the bore of said adapter housing to close the flow of fluid through said bore responsive to the level of fluid in a container to be filled including magnet means adapted to serve as a valve seat and valve sealing means operatively disposed within said cylindrically shaped lower discharge portion of said bore including a slidably supported float member within said cylindrically shaped lower portion having a metallic top end which magnetically co-acts with said magnet means, said float member being adapted to operate responsive to the level of fluid in a container to be filled.

4. An overfill safety adapter suitable for use about the outlet end of funnels or spouts being used to transfer fluid from one container to another, said adapter comprising:

an elongated housing member with at least a portion of its outer surface being of a substantially frusto conical shape adapted to be releasably fittably within an opening of a container to be filled having a bore therethrough, said bore having a conically-shaped upper portion being tapered such that it has a range of inside diameters for releasably mounting said adapter about an outlet end of a variety of different size funnels or spouts and a substantially cylindrically-shaped lower discharge portion, and valve means within the bore of said adapter housing to close the flow of fluid through said bore responsive to the level of fluid in a container to be filled.

5. A safety funnel to prevent fluid overfill of the container, said funnel comprising:

a reservoir body;

a depending elongated discharge spout, and an overfill safety adapter releasably mounted about the discharge spout, said safety adapter comprising:

an elongated housing member with at least a portion of its outer surface being of frusto conical shape and having a bore therethrough in communication with said discharge spout, said bore being conical in shape and being tapered such that it has a range of inside diameters for engaging and securing said adapter to a variety of different size funnels or spouts.

* * * * *